US007092815B2

(12) United States Patent
Dort

(10) Patent No.: US 7,092,815 B2
(45) Date of Patent: Aug. 15, 2006

(54) TRAFFIC CONTROL SYSTEMS FOR VEHICLE SPACING TO DISSIPATE TRAFFIC GRIDLOCK

(75) Inventor: David Bogart Dort, Washington, DC (US)

(73) Assignee: VRBIA, Inc., Arlington, VA (US)

( * ) Notice: Subject to any disclaimer, the term of this patent is extended or adjusted under 35 U.S.C. 154(b) by 40 days.

(21) Appl. No.: 10/786,177

(22) Filed: Feb. 23, 2004

(65) Prior Publication Data

US 2004/0260455 A1 Dec. 23, 2004

Related U.S. Application Data

(63) Continuation-in-part of application No. 10/772,776, filed on Feb. 5, 2004.

(60) Provisional application No. 60/529,973, filed on Dec. 17, 2003.

(51) Int. Cl.
*G08G 1/08* (2006.01)
*G08G 1/09* (2006.01)

(52) U.S. Cl. ..... 701/117; 701/213; 340/919

(58) Field of Classification Search ..... 701/117, 701/213, 96, 301, 115, 35; 340/995.13, 905, 340/933, 919, 928, 935, 941, 903; 180/169, 180/170, 178, 287
See application file for complete search history.

(56) References Cited

U.S. PATENT DOCUMENTS 3,593,262 A * 7/1971 Spencer ..... 340/932
3,750,099 A * 7/1973 Proctor ..... 340/932
3,835,950 A * 9/1974 Asano et al. ..... 180/167

(Continued)

FOREIGN PATENT DOCUMENTS

EP 667020 8/1995

(Continued)

OTHER PUBLICATIONS

Millimeter Wave Radar Technology for Automotive Application, Mitsubishi Electric Adv. 2001 (Summary).

(Continued)

*Primary Examiner*—Dalena Tran
(74) *Attorney, Agent, or Firm*—Rubinstein Law Group, P.C.; David Bogart Dort

(57) ABSTRACT

The present invention is designed to complement the existing transportation infrastructure in order to alleviate ever-worsening traffic congestion in problematic areas by minimizing the impact of driver "bunching" habits and/or external events that lead to congestion problems. Events alleviated by the present invention may happen at naturally occurring roadway infrastructures such as merges, lane shifts, and exits, and under conditions like rush hour, accidents, stand-stills, and HOV lane activation times. Further, vehicles allowing their speed and spacing to be controlled should have access to high-flow lanes. This invention will best and most safely be implemented at low speeds when congestion is most problematic and bunching habits prevent the dissipation of gridlock. In particular embodiments, the invention will regulate multiple vehicle accelerations (non-negative acceleration) once a low threshold speed has been reached through the transmission of signals to receivers in properly equipped vehicles. The transmitters are connected to a computational network that allow for increased spacing over a zone or a plurality of zones. In the preferred embodiment, only non-negative acceleration is governed keeping the safety features of the non-negative acceleration governor to a minimum.

11 Claims, 15 Drawing Sheets

U.S. PATENT DOCUMENTS

| | | | | |
|---|---|---|---|---|
| 5,134,393 | A * | 7/1992 | Henson | 340/933 |
| 5,289,183 | A | 2/1994 | Hassett et al. | |
| 5,420,794 | A | 5/1995 | James | |
| 5,526,357 | A | 6/1996 | Jandrell | |
| 5,581,464 | A * | 12/1996 | Woll et al. | 701/35 |
| 5,769,051 | A | 6/1998 | Bayron et al. | |
| 5,803,043 | A | 9/1998 | Bayron et al. | |
| 6,011,515 | A | 1/2000 | Radcliffe et al. | |
| 6,094,616 | A * | 7/2000 | Andreas et al. | 701/96 |
| 6,106,458 | A | 8/2000 | Robinson et al. | |
| 6,112,152 | A * | 8/2000 | Tuttle | 701/115 |
| 6,134,499 | A | 10/2000 | Goode et al. | |
| 6,163,277 | A | 12/2000 | Gehlot | |
| 6,166,658 | A | 12/2000 | Testa | |
| 6,285,943 | B1 | 9/2001 | Boulter | |
| 6,356,833 | B1 * | 3/2002 | Jeon | 701/93 |
| 6,427,114 | B1 | 7/2002 | Olsson | |
| 6,459,983 | B1 * | 10/2002 | Lichtenberg et al. | 701/96 |
| 6,483,443 | B1 * | 11/2002 | Lees et al. | 340/933 |
| 6,657,558 | B1 * | 12/2003 | Horita et al. | 340/995.13 |
| 6,666,411 | B1 | 12/2003 | Hart et al. | |
| 2001/0003808 | A1 | 6/2001 | Jeon | |
| 2002/0016663 | A1 | 2/2002 | Nakamara | |
| 2002/0032515 | A1 | 3/2002 | Nakamara | |
| 2002/0067660 | A1 | 6/2002 | Bokhour | |
| 2002/0072843 | A1 | 6/2002 | Russell et al. | |
| 2002/0084887 | A1 | 7/2002 | Arshad et al. | |
| 2003/0004633 | A1 | 1/2003 | Russell et al. | |
| 2003/0216582 | A1 | 11/2003 | Wilson | |
| 2003/0222180 | A1 | 12/2003 | Hart et al. | |

FOREIGN PATENT DOCUMENTS

| | | |
|---|---|---|
| EP | 95110303.5 | 5/2001 |
| EP | 951103035 | 5/2001 |
| WO | WO9501607 | 1/1995 |
| WO | 1995-19598 | 7/1995 |
| WO | WO1995019598 | 7/1995 |
| WO | WO2000-11629 | 3/2000 |
| WO | 2000-24626 | 5/2000 |
| WO | WO2000024626 | 5/2000 |
| WO | 2000-46743 | 8/2000 |
| WO | WO2000046743 | 8/2000 |
| WO | 2000-58752 | 10/2000 |
| WO | WO2000058752 | 10/2000 |
| WO | 2001-26329 | 4/2001 |
| WO | WO2001026329 | 4/2001 |
| WO | 2002-14098 | 2/2002 |
| WO | WO2002014098 | 2/2002 |
| WO | 2003104833 | 12/2003 |
| WO | WO2003104833 | 12/2003 |

OTHER PUBLICATIONS

Global Development of Advanced Transportation Telematics, ISATA, 1996, Reflecting Tomorrow's Highways Today: The Use of RF Backscatter Reflection in Automatic Vehicle Identification (AVI) Systems. Jun. 3, 1996.

Millimeter Wave Radar Technology for Automotive Application *Mitsubishi Electric Adv.* 2001.

Global Deployment of Advanced Transportation Telematics, ISATA 1996, *Reflecting Tomorrow's Highways Today: The Use of RF Backscatter reflection in automatic vehicle identification (AVI) systems.* Jun 3, 1996.

* cited by examiner

TRAFFIC CONTROL SYSTEMS FOR VEHICLE SPACING TO DISSIPATE TRAFFIC GRIDLOCK

REFERENCE TO PRIORITY DOCUMENTS

This patent application is a continuation-in-part and claims priority under 35 USC §120 to U.S. application Ser. No. 10/772,776, filed Feb. 5, 2004, which claims priority under 35 U.S.C §119(e) to U.S. Provisional Application 60/529,973 entitled TRAFFIC CONTROL AND VEHICLE SPACER SYSTEM FOR THE PREVENTION OF HIGHWAY GRIDLOCK by David Bogart Dort, filed in the United States Patent and Trademark Office on Dec. 17, 2003 and which is incorporated herein by reference for all purposes.

BACKGROUND

It is well-known in traffic flow mathematics that the closer vehicles are spaced together the slower the flow, and this is shown by the general traffic flow principle expressed by the equation:

where r(n,m) is the distance between two vehicles, n and m, and dn/dt and dm/dt represent the velocity of the two vehicles: as $r(n,m)\rightarrow 0$, $dn/dt\rightarrow 0$ and $dm/dt\rightarrow 0$ as well.

The main problem in getting a congestive traffic event flowing again is actually the behavior of the drivers themselves. FIGS. 1A–1C show the behavioral characteristics of drivers that cause continued gridlock problems. The main problem is that drivers fail to space themselves apart from a vehicle in front of them (or, in a merge situation, a two-dimensional spacing) when the traffic flow resumes, thus keeping r(n,m) close to 0 at all times. Even if a driver is attempting to space themselves from the leading vehicle, an erratic "dissipation speed" may bunch the two cars again keeping traffic from flowing. FIG. 1A shows a representative traffic event at time T(E) or time of event, the location of the event is shown by a star and labeled P(tc) where the velocity of the representative four vehicles is near zero (v vector =0). FIG. 1B depicts the initial dissipation of the traffic congestion event in FIG. 1A and a chosen t(0) or initial time. In FIG. 1B the distance r(n,m) initially may increase, but as shown in FIG. 1C at time t(0)+i (where i=2 seconds in the illustrative example), r(n,m) is decreased through driver behavior (acceleration (a(n)), not letting a vehicle merge properly, etc.) or other circumstances to decrease distance and leading back to congestion as shown by the bunching in vehicles 3 and 4 and the closing gap between n and m.

FIG. 2 also depicts another type of congestion based on driver habits in a highway merge zone which causes unnecessary slowing and congestion problems. The merges tend to complicated traffic flow both in the merge lanes and the travel lane into which the merge lane flow and the adjacent lanes. In this diagram, velocity x is a threshold velocity which indicates that the travel lane traffic has dropped below a target velocity most-likely due to the problems created by the merge lane traffic. The velocity of the vehicle in the lane adjacent to the travel lane while at a threshold will also likely drop below the threshold if vehicles in the travel lane continue to pull into the adjacent lane from low or stopped velocity.

A way to keep efficient spacing during the dissipation of a traffic congestion event would facilitate traffic flow and reduce the problems caused by driver impatience and other natural occurring traffic events such as merges.

SUMMARY OF THE INVENTION

The present invention is designed to complement the existing transportation infrastructure in order to alleviate ever-worsening traffic congestion in problematic areas by minimizing the impact of driver "bunching" habits and/or external events that lead to congestion problems. Events alleviated by the present invention may happen at naturally occurring roadway infrastructures such as merges, lane shifts, and exits, and under conditions like rush hour, accidents, stand-stills, and HOV lane activation times. Further, vehicles allowing their speed and spacing to be controlled should have access to high-flow lanes. This invention will best and most safely be implemented at low speeds when congestion is most problematic and bunching habits prevent the dissipation of gridlock. In particular embodiments, the invention will regulate multiple vehicle accelerations (non-negative acceleration) once a low threshold speed has been reached through the transmission of signals to receivers in properly equipped vehicles. The transmitters are connected to a computational network that allow for increased spacing over a zone or a plurality of zones. In the preferred embodiment, only non-negative acceleration is governed keeping the safety features of the non-negative acceleration governor to a minimum.

BRIEF DESCRIPTION OF THE DRAWINGS

The invention can be better understood by reference to the following illustrative drawings, in which.

DETAILED DESCRIPTION

Figure 1A:
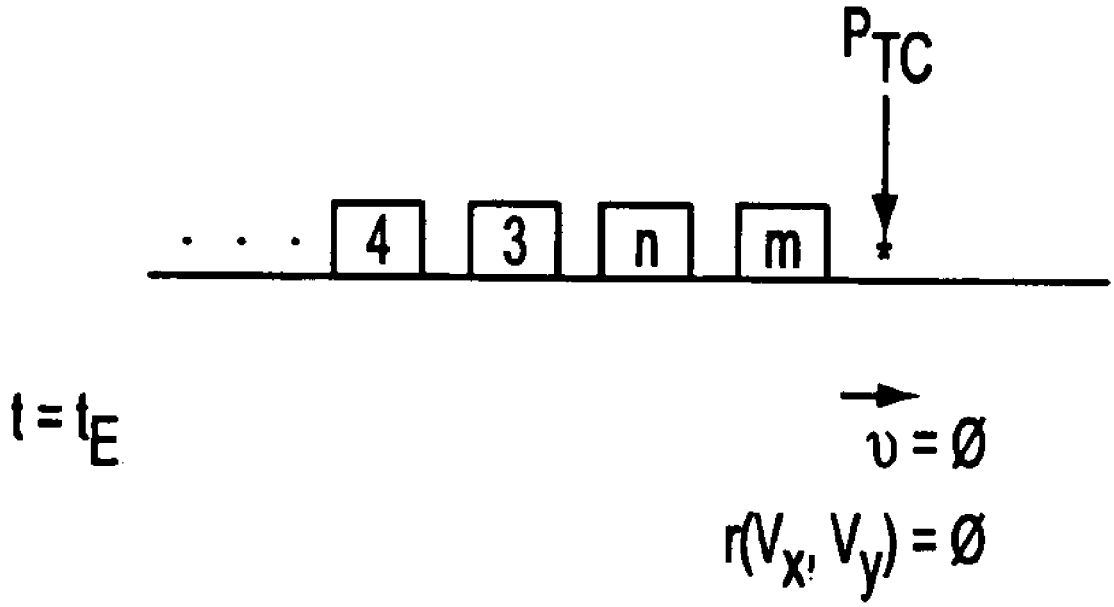
FIGS. 1A–C show a traffic flow congestion event in three respective time sequences.

Various aspects of vehicular control, RF transmission, and traffic control are taught in specific patents which are incorporated herein by reference. These include U.S. Pat. Nos. 4,449,114, 4,403,208, 4,356,489 for RF aspects of vehicle sensing. Other background technology incorporated herein for teaches various aspects of the components of the invention include: U.S. Pat. No. 6,356,833 to Joen teaches a the RF control of a vehicle in a particular driving state. See Also. WIPO Pat. Publication 2000-11629 to Olsson teaches reducing traffic through route control (See also U.S. Pat No. 6,427,114). WIPO Pat. Publication 1998-35276 to Douglas teaches a navigating system using RF transmission to vehicles in a workplace. U.S. Pat. No. 5,289,183 to Hassett et. al. teaches a-plurality of read write transponders in roadway sensors that collect information about specific vehicles.

The following references provide other background to the present invention: U.S. Pat. Publication 2003-0222180 to Hart et al from Ser. No. 10/157,859 teaches (See also EP pat. Pub. 1366967, U.S. Pat. No. 6,666,411). U.S. Pat. Pub. 2003-0216582 to Wilson teaches a maximum speed monitoring device that is programmable. U.S. Pat. Pubs. 2003-0004633 and 2002-0072843 to Russell et. al. from U.S. application Ser. Nos. 10/217128 and 09/931630 teaches a system for adjusting cruise control so that a safe distance is kept between vehicles. U.S. Pat. Pub 2002-0084887 to Arshad et. al from U.S. application Ser. No. 09/752,009 teaches monitoring a vehicle by transponder in order to prevent disabling operation of the vehicle. U.S. Pat. Pub. 2002-67660 to Bokhour from U.S. application Ser. No. 09/977,858 teaches collision avoidance system based on RF. U.S. Pat. Pubs. 2002-32515 and 2002-16663 to Nakamara from U.S. application Ser. No. 09/986364 and 944201 teaches a collision avoidance system by measuring the distance from the preceding vehicle.

Other useful references for understanding various components and concepts related to the present invention may include: WIPO Pat. Pub. 2002-14098 to Lipper teaches an adaptive cruise control system. WIPO Pat. Pubs. 2001-26329 and 26068 to Gelvin teach systems for networking sensors in a wired and wireless environments. WIPO Pat. Pub. 1995-19598 to Knapp teaches an automotive RF control system. WIPO Pat. Pub. 2000-58752 to Sorrels et al (NERAC listing #139) teaches RFID tags with sensor inputs. WIPO Pat. Pub. 2000-46743 to Cohen (NERAC listing #143) teaches an array tracking system. WIPO Pat. Pub. 2000-24626 to Gilbert et al (NERAC listing #145) teaches control of multiple vehicle on a monorail through a network. WIPO Pat. Pub. 1995-1607 to James teaches an automated highway in which the vehicle can communicate through transponders. See U.S. Pat. No. 5,420,794. Global Deployment of Advanced Transportation Telematics, ISATA 1996, *Reflecting Tomorrow's Highways Today: The Use of RF Backscatter reflection in automatic vehicle identification (AVI) systems*. Jun. 3, 1996. U.S. Pat. No. 6,155,558 to Testa teaches a speed limit transmission device. U.S. Pat. No. 6,112,152 to Tuttle teaches an RFID communication system for an automobile. U.S. Pat. No. 6011515 to Radcliffe et. al teaches a system for sensing traffic conditions and relaying them to a traffic center. U.S. Pat. No. 5,803,043 and 5,796,051 to Bayron et al teaches an input system for a power and speed controller. U.S. Pat. No. 5,526,357 to Jandrell teaches a system for locating a transponder unit. Speed limit control inventions are taught in U.S. Pat. No. 6,285,943 to Boulter, U.S. Pat. No. 6,163,277 to Gehlot, and U.S. Pat. No. 6,134,499 to Goode et. al, and U.S. Pat. No. 6,016,458 to Robinson et al. all incorporated by reference. These inventions may have particular aspects that may be useful in considered the structure and operation of the presently claimed invention, but are not contemplated in the solution of regional traffic problems caused by bunching, merges or other traffic congestion phenomena.

Figure 1B:
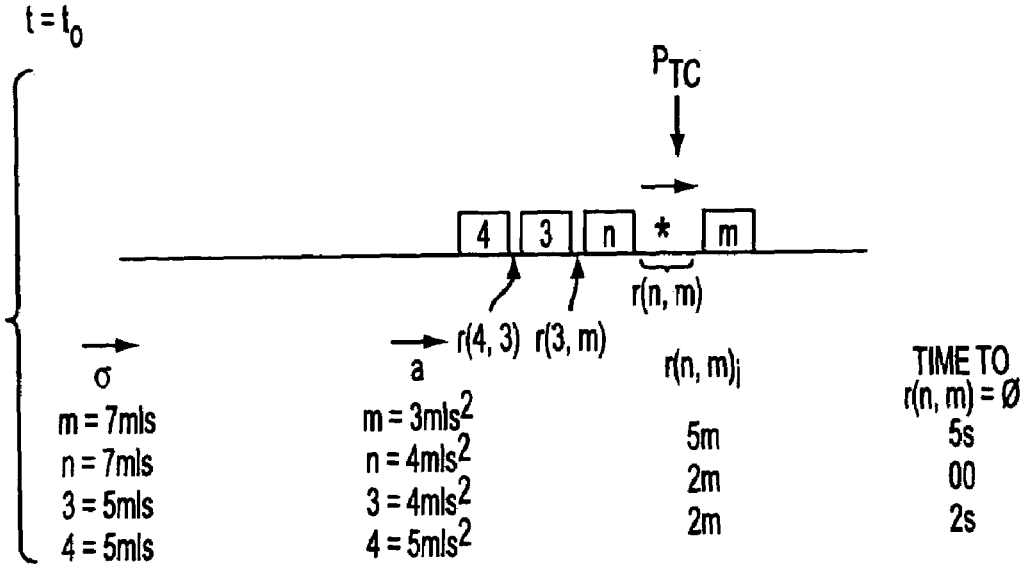
Figure 1C:
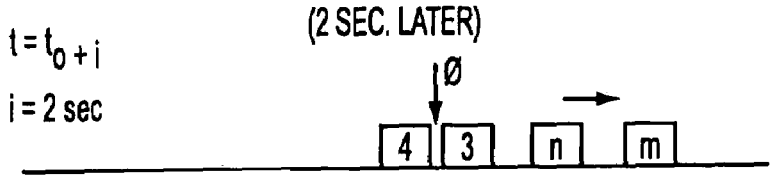
Figure 2:
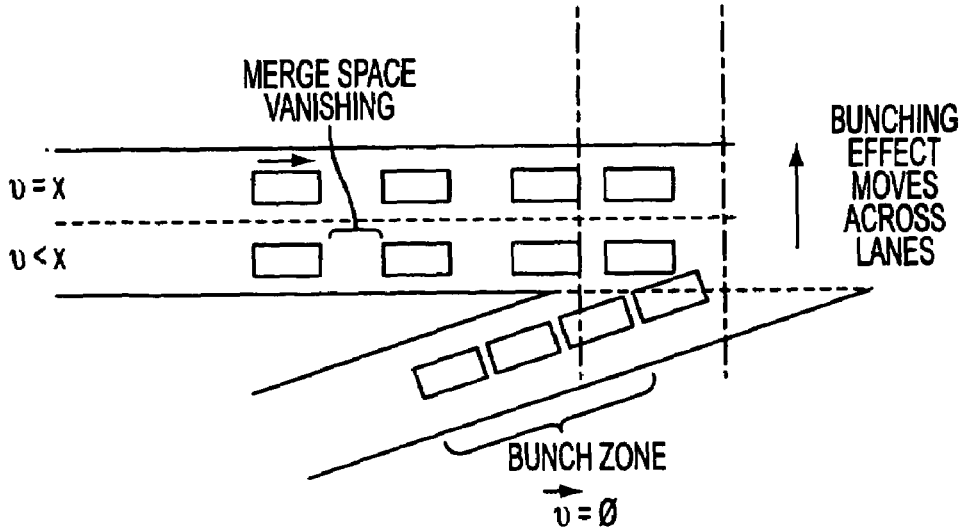
FIG. 2 shows a traffic congestion event based on merged traffic.
Figure 3A:
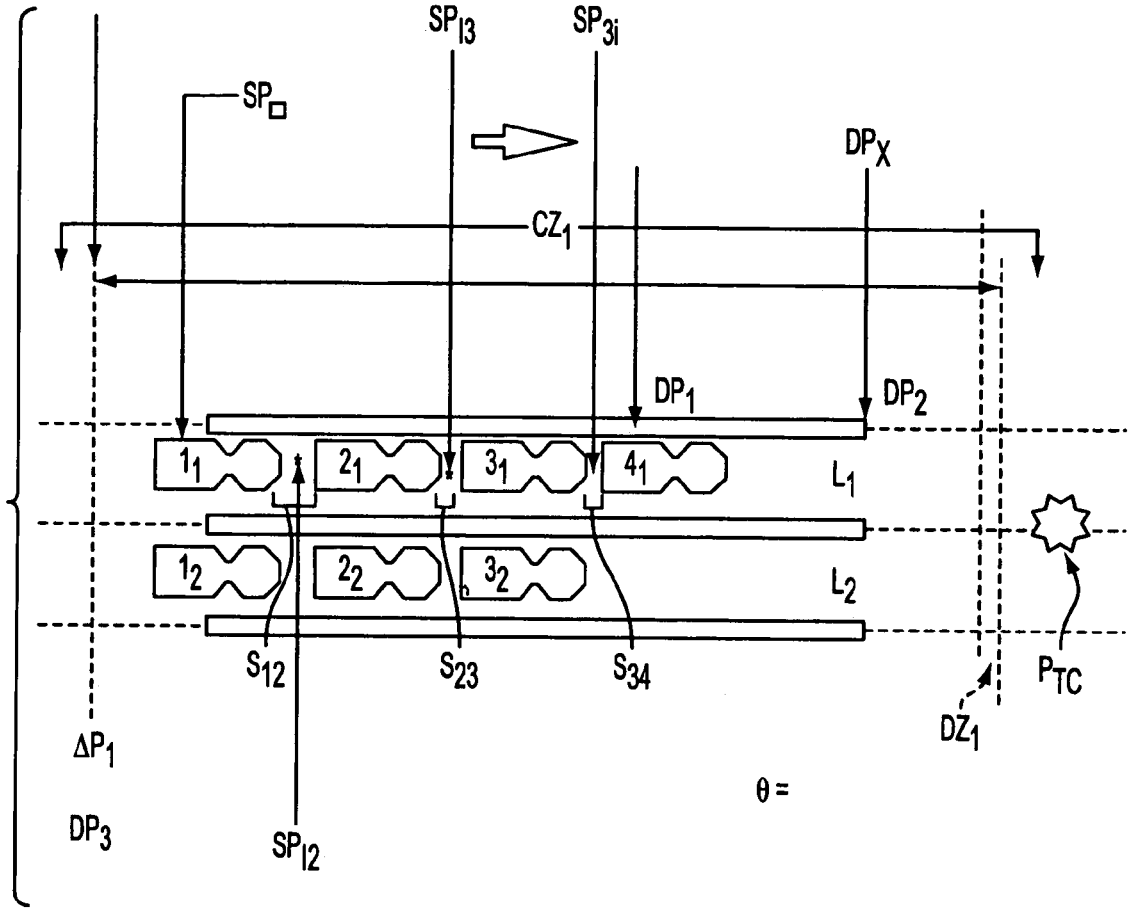
FIG. 3A is the traffic flow control system before activation.

A traffic flow event, such as stopped vehicles is detected to motion detectors at detection points in the speed control area or congestion control zone is shown in FIGS. 1A–C or merge zone in FIG. 2. Referring now to FIG. 3A, a functional diagram of the invention is shown. The stopped or slowed vehicle(s) in lane 1, L1 shown as V1(1), V2(1), V3(1), V4(1) activates the spacing system at the activation zone, AZ, or activation points, AP(x), AP(1) that activate and allows spacers S(rearnum, frontnum), shown as S(1-2), S(2-3), S(3-4) to prevent vehicles from bunching up by operating in the "stop and go" mode. The spacers can be physical devices such as Kevlar flags attached to a moving conveyor (with appropriate springs or other mechanical protection in the mechanical movement area or layer (not shown)) or electronic such as lights or diodes, but in a preferred embodiment are transmitter-receiver systems which control the speed of the vehicle, through controlling the acceleration of the vehicle after an event is detected at detection points, DP(1), DP(2) or detection zones DZ(1).

Figure 3B:
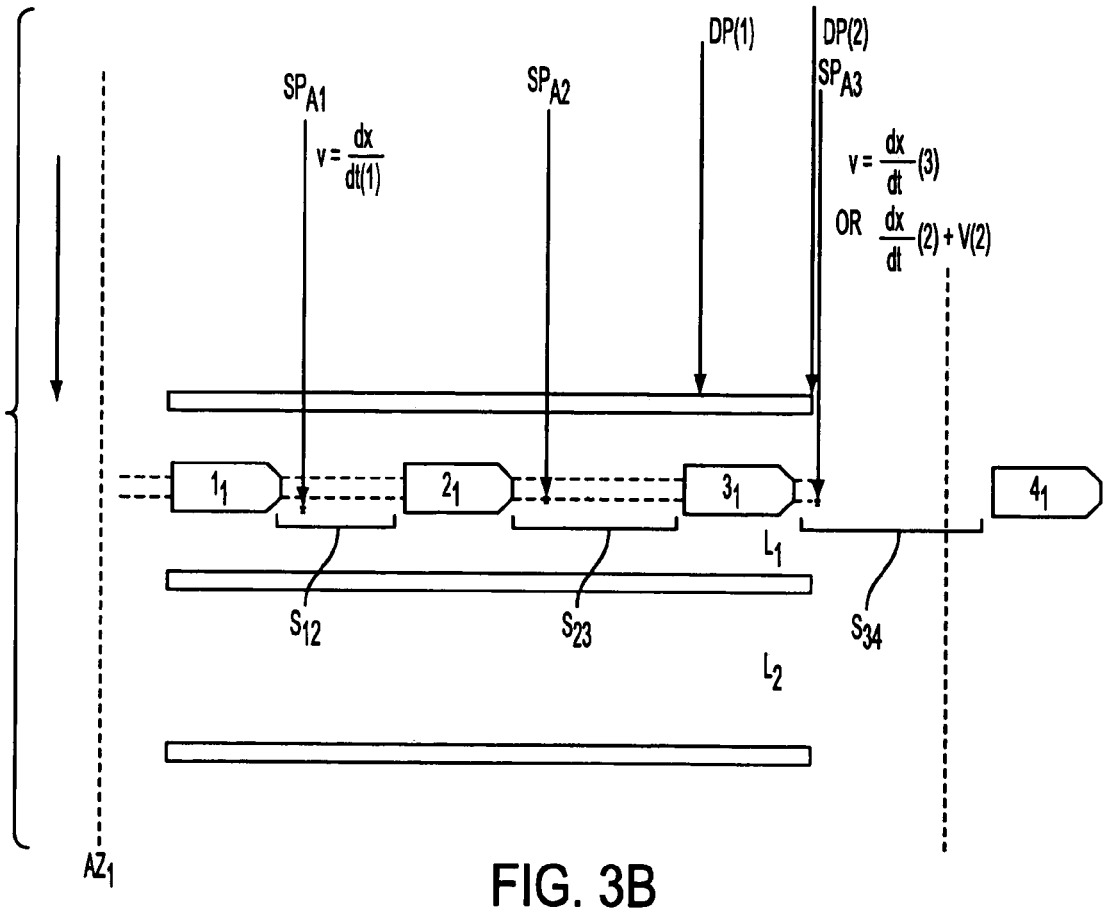
FIG. 3B is the traffic flow control system after activation.

FIG. 3B shows the conceptual implementation of the invention with the spacers implementing the flow control (or in an active state). Spacer controls S(1-2), S(2-3) and S(3-4), are activated when an activation event is detected at detection zone or detection point(s), DP1, DP2, such as the velocity of any vehicle in the congestion zone (not shown) reaches a low threshold, which is zero in a preferred embodiment. Spacer S(3-4) allows the distance to increase between vehicles V4 and V3, in lane L1, by allowing V4 to accelerate faster than V3. Similarly V3 is allowed to accelerate faster than V2 through spacer S(2-3), increasing the distance between V2 and V3. The spacers are either simultaneously or serially deactivate, when a release event is detected in the detection zone or detection points, DP1 or DP2. For example if the velocity of a vehicle at DP(1) is 10 m/s then traffic flow is no longer necessary in at least a portion of the congestion zone. Other release event criteria may be appropriate such as the distance between V4 and V3, or any two vehicles in the sequence is great enough where flow control is no longer necessary. One of the advantages of the present invention is that it need not be active when traffic is flowing acceptably.

The sensors at the detection points will determine that the traffic congestion event has ended and deactivate the spacers allowing traffic to proceed normally. It is contemplated that these sensors are generally well-known as stand-alone devices, and can be pressure strips in the roadway, optical sensors, RADAR velocity detectors, timing devices, or any combination thereof. It can be appreciated that the particular traffic sensing device is not vital to the invention other than the information detected will have to be processed by the control system and thus, interface devices should be careful considered during implementation, in addition to environmental conditions, durability and cost. For example pressure. strips in the roadway may have more maintenance free durability than other devices.

As will be discussed subsequently, the calculations necessary to produce the desired spacing, velocity and acceleration control range from simple to complex calculations for the application of differential equations to traffic flow problems. A good. reference regarding the calculation/computation aspect of the invention is *Traffic Flow Fundamentals*, by May (Prentice-Hall, 1989), *Mathematical Theories of Traffic Flow*, by F. A. Haight, (Academic, 1963), as far as teaching the necessary computation solutions related to traffic control implementation, these references are. incorporated by reference. Particularly useful references published by the Transportation Research Board are *Highway Capacity Traffic Flow and Traffic Control Devices*, (June, 1977) and *Traffic Flow Theory and Highway Capacity* (June 1989), which are both incorporated by reference herein for all purposes. Another useful reference is *Multiclass Continuum Modelling of Multilane Traffic Flow* by Serge Hoogendoorn, (Coronet, 1999). The computational aspects-of the invention are not the novel and non-obvious aspects, but are important aspects of implementing the invention in simple or complex traffic control systems.

Figure 3C:
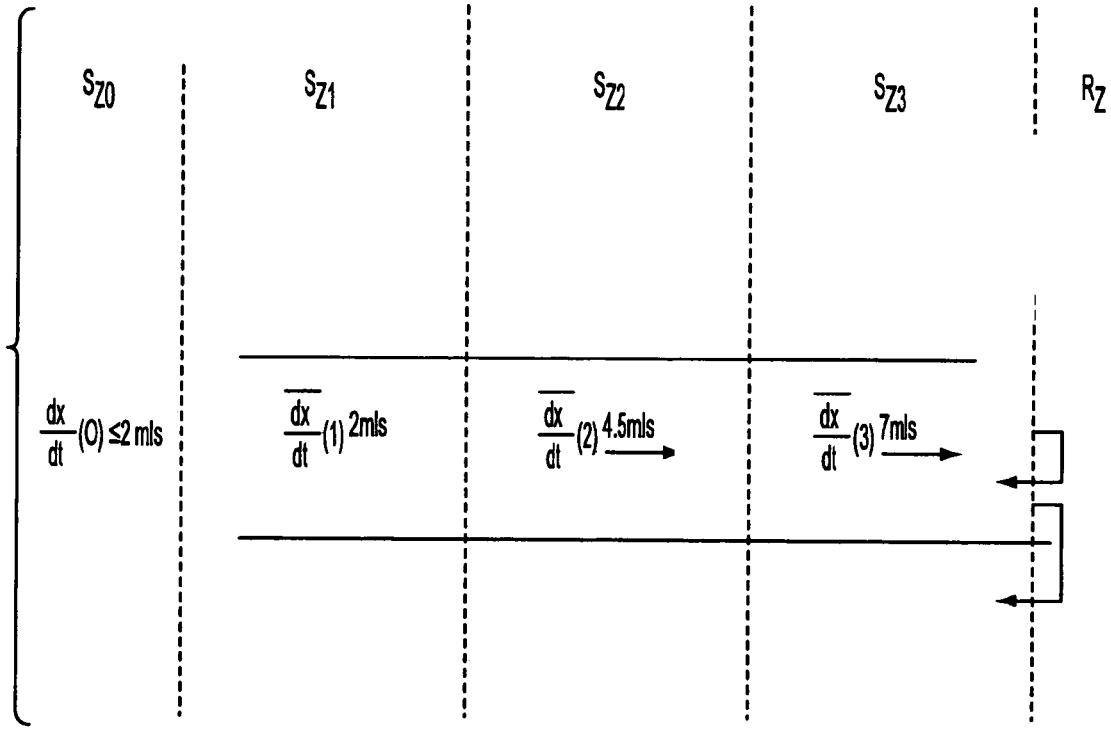
FIG. 3C shows the representation slot zones and sample corresponding velocities for spacing.

Referring now to FIG. 3C, a portion of the congestion zone (not shown) includes control zones or Slot Zones, shown as SZ0, SZ1, SZ2, SZ3 at one end of the congestion zone is a release zone (RZ), which may be any of the slot zones if it is appropriate, but is shown for illustrative purposes such that velocity, spacing and acceleration control is not present in this zone. As illustrated by FIG. 3 the average velocity in the respective slot zones allows for-the spacing of vehicles in the front of the zone. Thus, vehicles in SZ3 are allowed to travel at 7 m/s, in SZ2 4.5 m/s, SZ1 2 m/s. In SZ0 the average vehicle velocity-may or may not need to be controlled depending on the conditions in the front slot zones.

FIG. 3C shows representational slot zones Sz0, Sz1, Sz2, Sz3 (and release zone Rz) each with sample average velocities that allow the vehicles to space out increasing traffic-flow speed. The structures are a single embodiment of the invention, but not the preferred embodiment as it is contemplated that building any type of infrastructure would be prohibitive difficult with existing crowded highways. Rather, the effect of the physical structures may be contemplated in other embodiments that implement components that require cooperation between systems and will be discussed below.

Figure 3D:
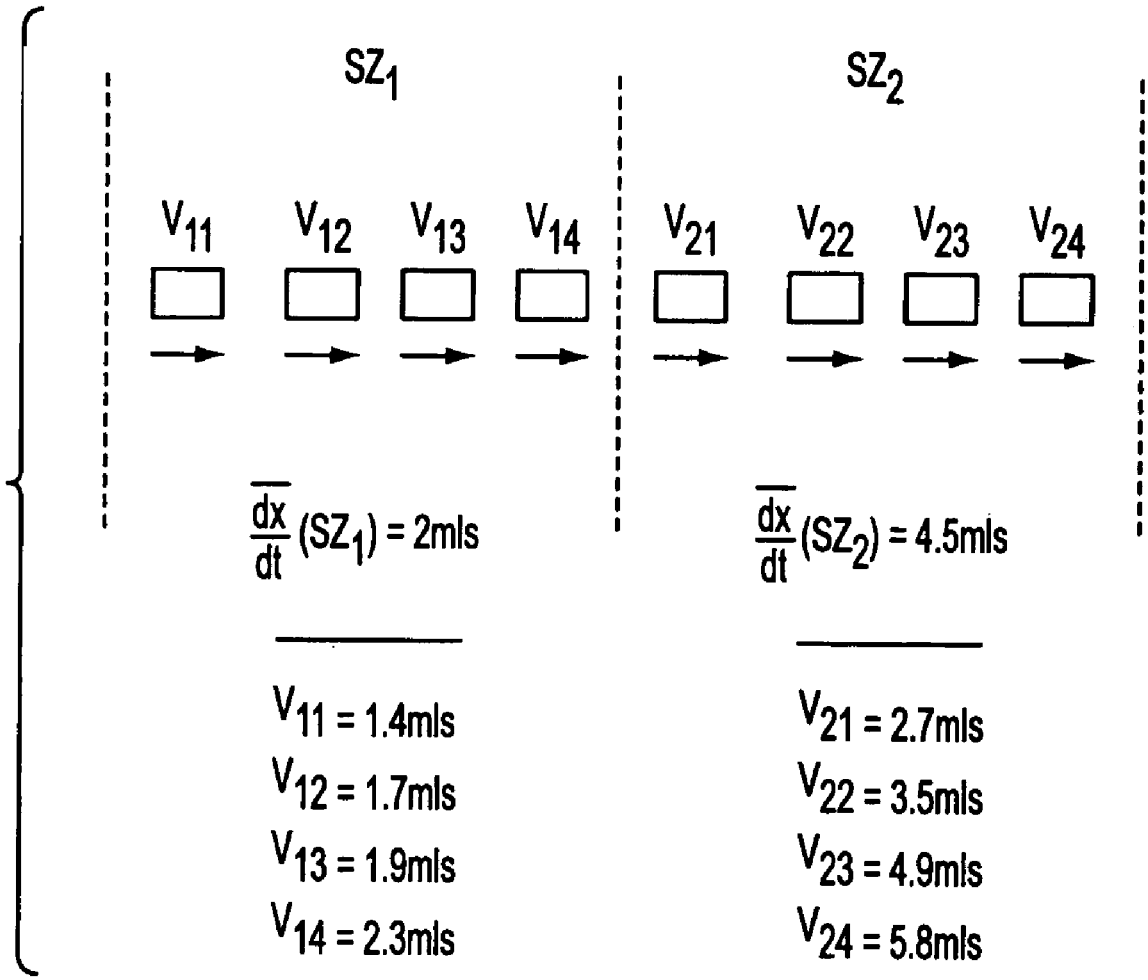
FIG. 3D is a closer view of two representative slot zones.

FIG. 3D is a close up of two individual acceleration control zones, Sz1 and Sz2, and a sample of four representative vehicles in each respective zone (V11–V24) and their speeds or velocity limitations. Each zone may include more than four vehicles, or less than four depending on the effectiveness of individual implementations of the transmission systems. More than one vehicle may be allowed to travel at a velocity as long as the general principle of the invention is being applied to dissipate the congestions.

Figure 5A:
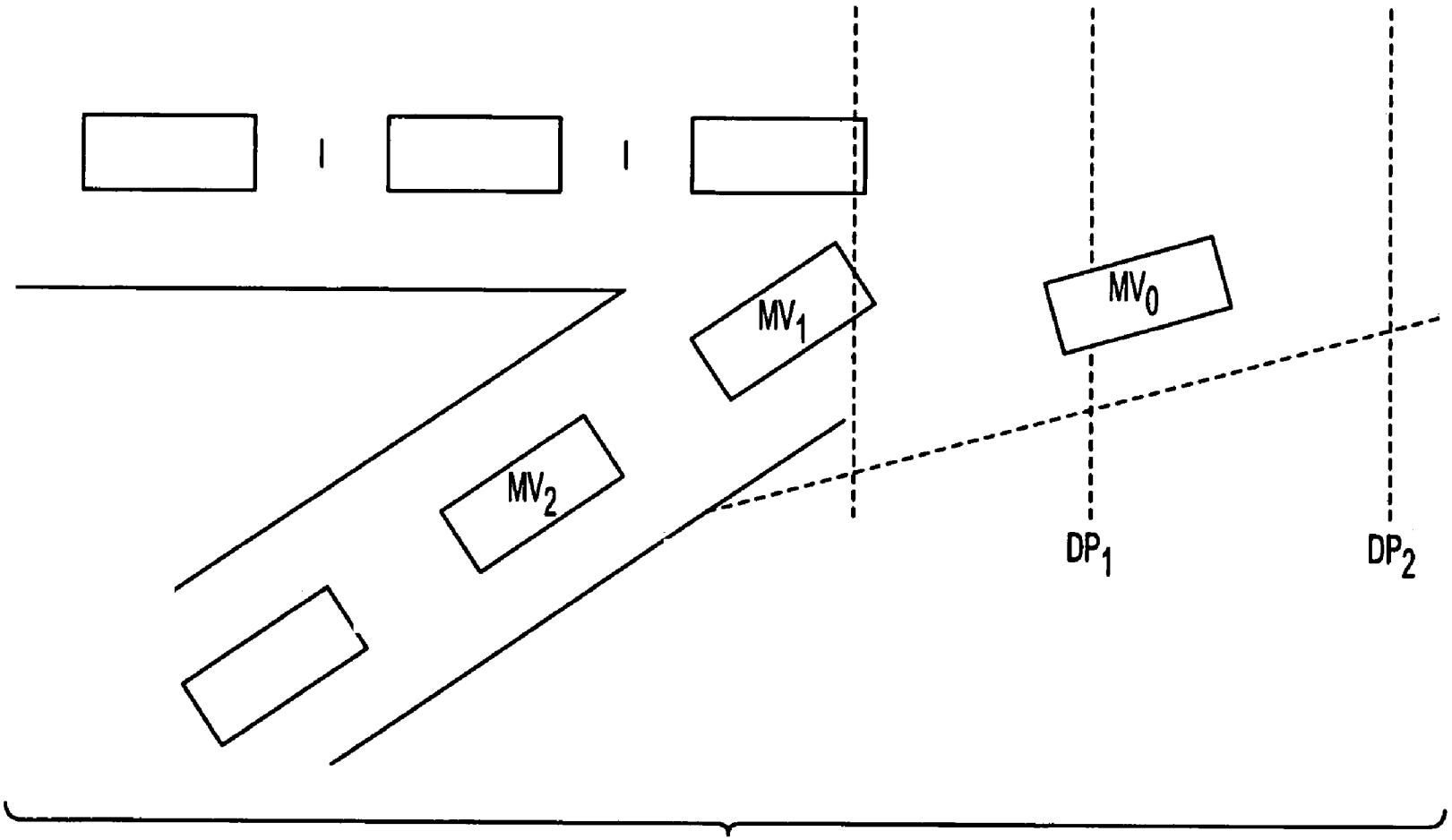
FIG. 5A is a merge control system embodiment of the invention at a first time.
Figure 5B:
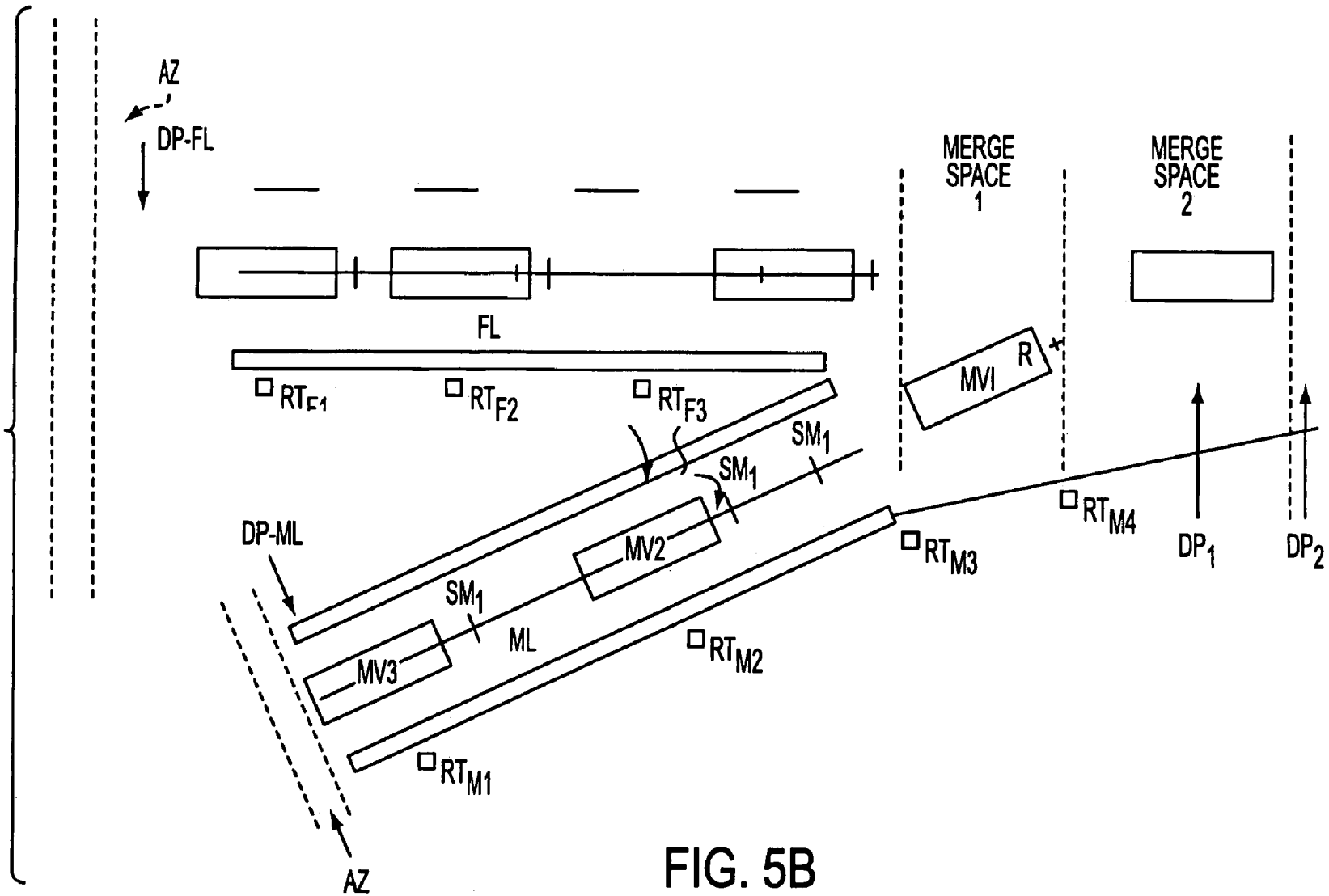
FIG. 5B shows the merge control embodiment at a second time.

As can be appreciated, the spacing control system may also be implemented in two dimensions. Not so much as an X and Y, but with regards to merges, exits, multiple lane controls, etc. The system can be used in the forward direction for single lane control flow, but also can be used for merging control such as on-ramp allowing cars to automatically enter a-created space, which is shown in a first state in FIG. 5A at time t(0). The invention is shown as activated at time t(0)+j in FIG. 5B. Thus, velocity control of vehicle in both the merging lane ML (MV1, MV2, MV3) and the Flow lane FL (FV1, FV2, . . . ) may be necessary. Although velocity control in only the merging lane ML may be needed depending on the events detected in detection points DP1 and DP2. Although in the merge lane context detection points, DP-FL and at the rear of the congestion zone (not shown) and the merge lane DP-ML may be more desirable.

Figure 4A:
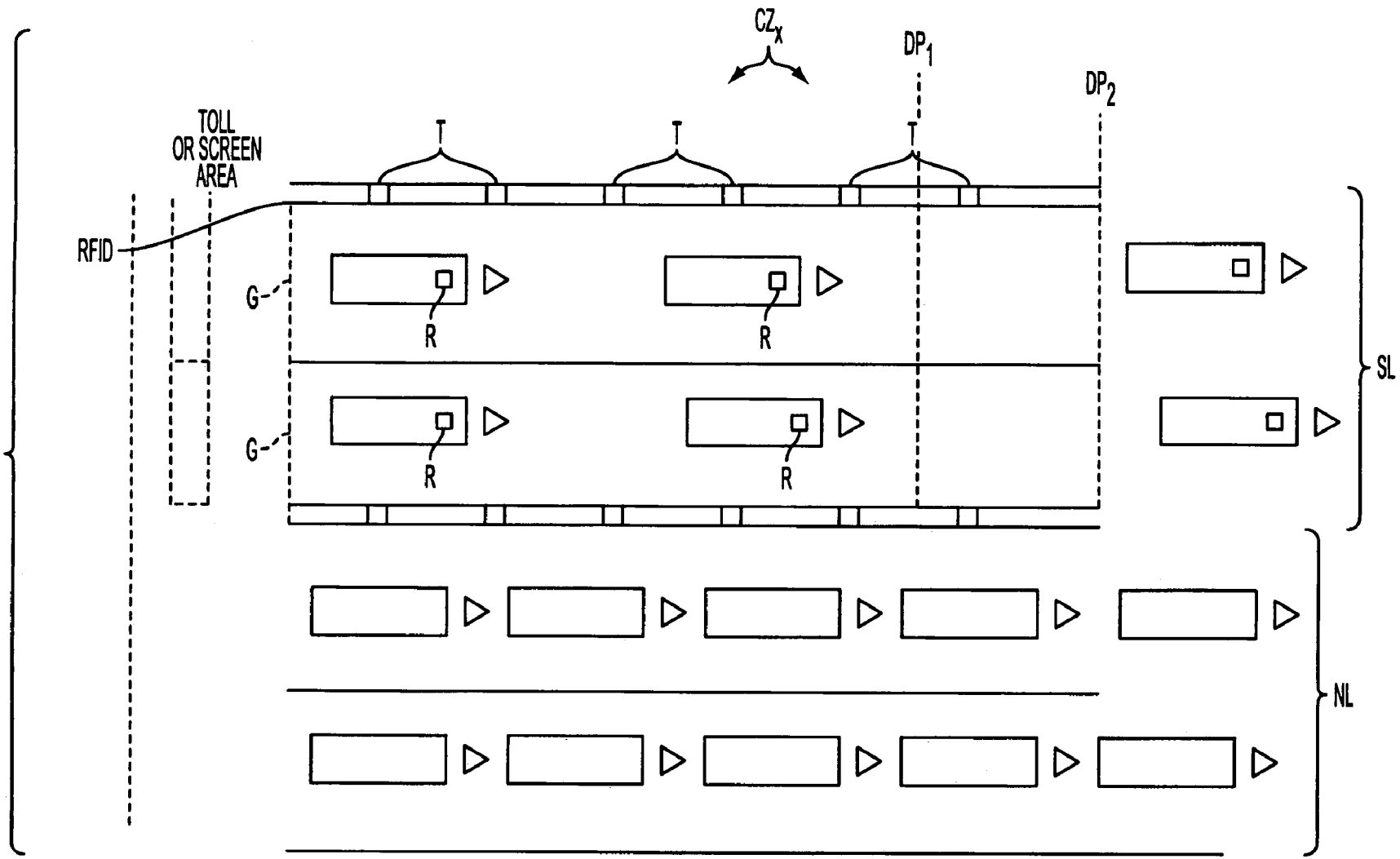
FIG. 4A is a sample of the invention as used in a comprehensive traffic congestion reduction system with control lanes and standard lanes.

Referring now to FIG. 4A, optional special lanes may only be entered through an RFID gate or tollway, in which cars have the automatic control (or not for a special tollway) allowing the top speed of the car to be governed in the case of a congestion event. Transmitters beneath or on the side of the roadway transmit the appropriate spacing speed for the slot zone preventing all congestion through proper traffic spacing. A method for implementing an access controlled traffic flow regulated system, like that shown in FIG. 4A may include access control that may implement desired regional traffic infrastructure features such as high occupancy vehicle (HOV) lane compliance. For example, in one of the implementations of the present invention, each subscriber is given an RFID transponder in the form of a keycard (not attached to the receiver). During HOV only rush hour periods, there must be two keycards in the vehicle at the TOLL SCREEN POINT in FIG. 4A to access the congestion-reduced zones of the present invention. In order that traffic not get jammed at the toll entrance, if an account holder accesses the congestion reduction zone without an additional keycard present (or a low account balance or other scenario) they may be charged additionally or taxed. Of course, a vehicle may simply be prevented from entering the zone without the special adaptation receivers, or charged additional money for such. It is contemplated that if multiple levels of access are desired a series of two or more RFID systems may be desired. Thus, the incentives to travel in the reduced congestion lanes which may be blocked off from the regular travel lanes can be adapted to help solve the needs of the regional traffic authorities.

Figure 4B:
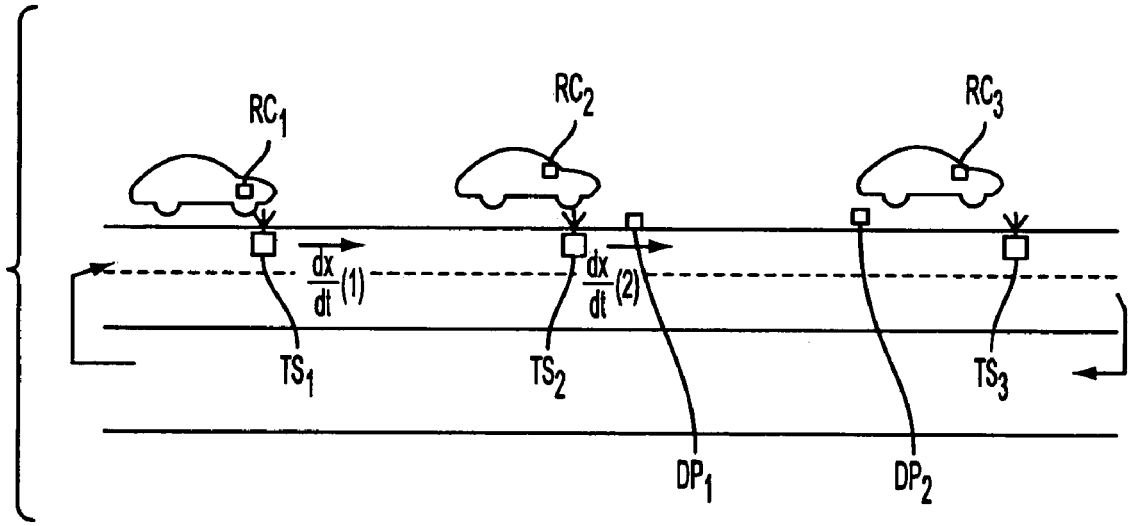
FIG. 4B is a diagram of the part of the traffic control system in a preferring RF broadcasting and receiving embodiment.

FIG. 4B is a side and blown up view of a section of FIG. 4A in a preferred representative embodiment that includes transmission devices TS1, TS2, TS3, connected to a control system (not shown) and a governor-receiver RC1, RC2 and RC3 in the vehicle that responds to each transmitter through a RF (with optional ID) system, such that the vehicle cannot accelerate beyond the appropriate slot zone speed after activation. Thus the vehicle in front is allowed to travel, for example, at 7 m/s while the vehicle in position 1 is only, allowed to travel at 1 m/s until reaching slot zone 2. The optional passive RFID systems in vehicles may also be used for tracking and are commonly implemented in such commercial applications as EZ-PASS in which a RFID device reads a transponder located in a moving vehicle to record a toll fee and to send a monthly bill. The transmission and reception system will be described more in detail below. Detection Points DP1 and DP2 may be used to detect velocity, speed, distance, or used for checking data received by the transmitter systems TSx. The transmitters do not need to be able to receive information from the vehicles in one embodiment if information regarding the overall traffic dissipation conditions is obtained. Thus, a simplest first embodiment would not use the RFID, but a simplified transmission that is received by each automotive receiver RCx to regulate its acceleration. As discussed above a "zone" may be treated as a single vehicle for the purpose of traffic dissipation. Thus all the cars in a zone may be allowed to achieve 6 m/s which the all the vehicles in trailing zone are allow to achieve 5 m/s, thus achieving the desired effect without the need for individualized information regarding each vehicle.

Figure 6A:
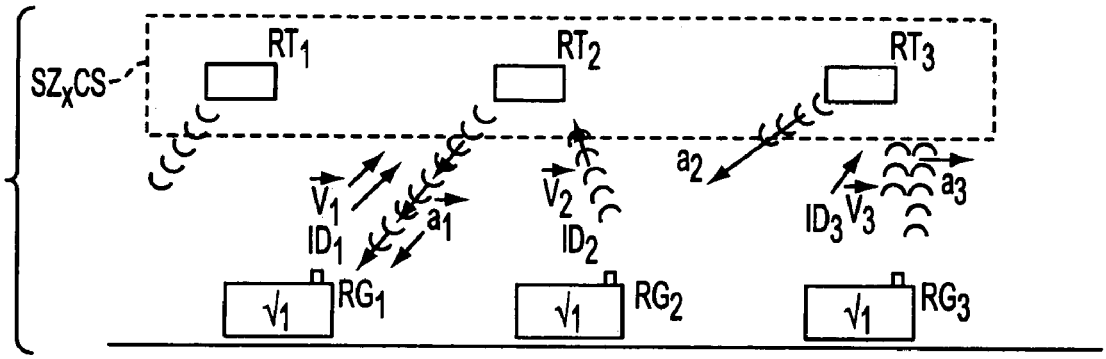
FIG. 6A is the traffic control invention that is implemented to stationary or moving transmitters in the speed control zone.

Referring now to FIG. 6A, a single transmission reception zone SZx is shown. In the control system for the slot zone SZxCS there are three transmitters RT1, RT2, RT3, and three sample vehicles V3, V2, V1 (the order has been changed to-show that numbering is arbitrary and for purposes of illustrations) with three respective velocities, σ1, σ2, and σ3 ("σ" is used for velocity instead of v). FIG. 6A also shows an optional initial transmission states as it applies to vehicles V1, V2 and V3 with respective receiver controller/governors RG1, RG2, and R3, respectively is shown. An optional ID is detected by the transmitter(s) RT2 and RT3 in a fashion similar to the EZ-PASS RFID systems used in toll lanes on many highways and based on a transponder located in a vehicle and in particular in the RGx device or adjacent thereto. Similarly, an optional broadcast of the vehicles current velocity al takes place along similar lines, although the broadcast is not passive like an ID would be. In a second transmission state an acceleration or velocity limit(s) a1, a2, and a3 are broadcast to the RG devices in order that the vehicles will not accelerate too quickly and create unnecessary congestion.

Figure 6B:
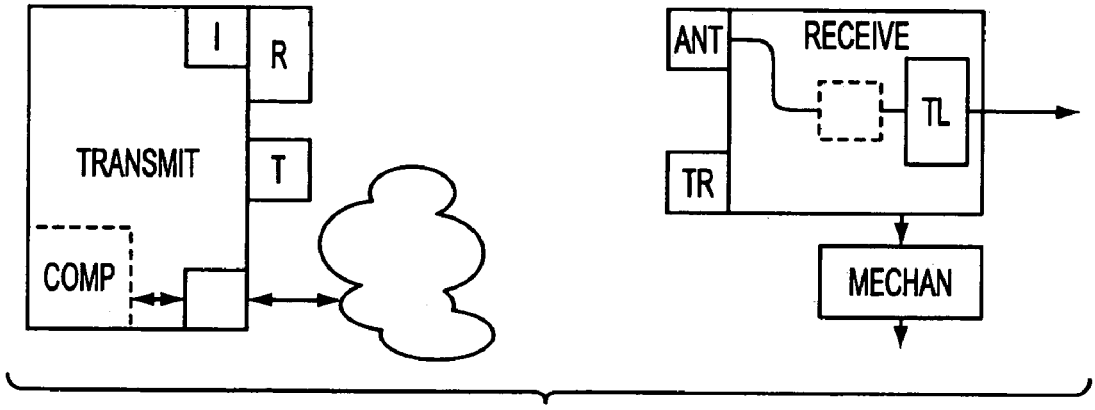
FIG. 6B is a transmission and receiver device represented by functional blocks in a first embodiment.

Referring now to FIG. 6B, the representative transmitter system T and receiver system R shown in FIG. 6A are shown. The transmitter system TRANSMIT may be an RFID broadcast device or other EMF transmission device using an appropriate frequency (approved by the FCC or on a free channel). The transmitter may also use optical signals. The transmitter system includes a transmitter Tr and a computational device COMP, which may be physically located in the transmitter system or virtually connected through transmission, LAN, or specialized network to other transmitter system devices through an optional network interface NI. The transmitter system may include and optional receiver Rc and input interface I that allow information from the transponders to be received and processed. The network may allow each transmission system T to be activated upon the detection of a traffic congestion event or simply include computation information to be transmitted to the Also shown in FIG. 6B is receiver system R, which include a device that allow acceleration or velocity control signals from the transmitter system T to be processed. An optional antenna or signal reception device takes EMF or other appropriate signals and processes them through an interface for translation in the translator TL, so that the signals may be used to control the acceleration of the vehicle. The processor PROC may be an ASIC designed specifically to quickly decode transmissions from the reception structures to a physical embodiment. As can be appreciated there are velocity/speed/acceleration control mechanisms used in vehicles for safety purposes, and in particular to slow SUVs when the SUV is detected by sensors to be in a rollover situation. As such, the driver of such vehicles is not in control of the velocity as it is being slowed to a safer speed.

Figure 7:
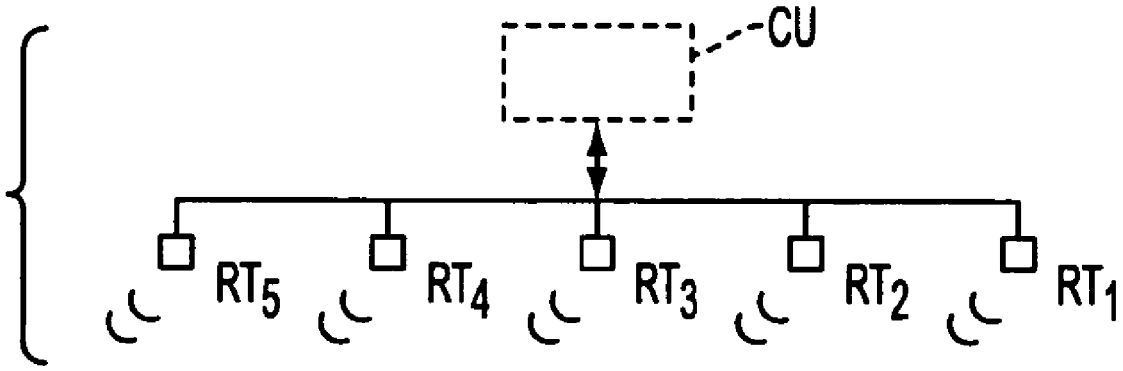
FIG. 7 illustrates the networked velocity control computation system.
Figure 8:
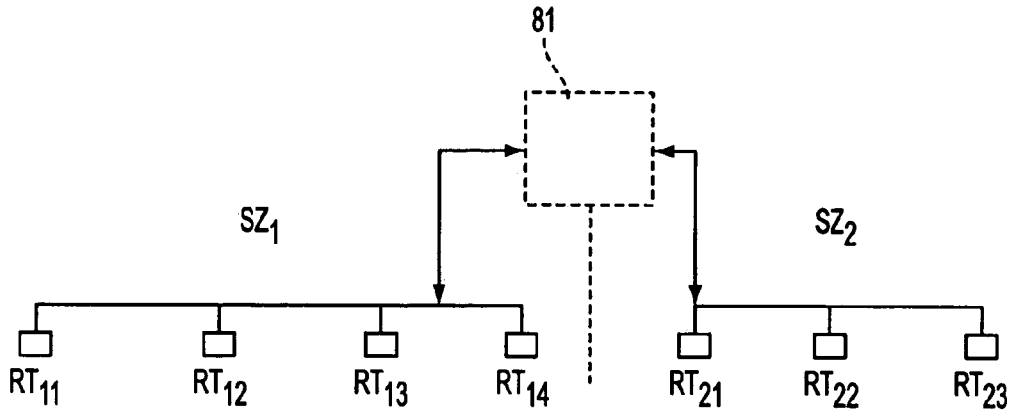
FIG. 8 illustrates a multiple zone network computation system and flow of data.

Referring now to FIG. 7 a networked series of transmission systems RT1 . . . RT5 connected to each other via a LAN, WAN, or wireless network to a physical or virtual computation device CU. The computation device considers the information form the various transmitters RT1, . . . , RT5 in the optional embodiment or simply calculates targeted velocity or acceleration control to be transmitted to vehicles in particular zones. The computation device CU may record data or actually control the transmissions and may be located anywhere in the networked system. The control computations will depend on many parameters, lanes, regional traffic conditions, driver behavior, recorded traffic events. Some of these are discussed in the incorporated references. A simplified example of a representative single lane traffic flow computation table is shown below. These tables are meant to be representative only of the information as can be appreciated by those skilled in the art. In the table below the vehicles shift one "slot" for 2 seconds traveled. The speed at the front of the congestion zone increases more quickly than that at the back of the zone.

TABLE 1

Representative Flow rates across RT coverage.

| Transmit (t = 0) | Vehicle | Transmit (t = 2s) | Vehicle |
|---|---|---|---|
| RT5 | V5-1: 7 m/s | RT5 | V5-1: Exit |
| | V5-2: 6.5 m/s | | V5-2: 7 m/s |
| | V5-3: 6.1 m/s | | V5-3: 6.5 m/s |
| | V5-4: 5.7 m/s | | V5-4: 6.1 m/s |
| RT4 | V4-1: 5.2 m/s | | V4-1: 5.7 m/s |
| | V4-2: 4.8 m/s | RT4 | V4-2: 5.2 m/s |
| | V4-3: 4.4 m/s | | V4-3: 4.8 m/s |
| | V4-4: 4.1 m/s | | V4-4 4.4 m/s |
| RT3 | V3-1: 3.7 m/s | | V3-1 4.1 m/a |
| | V3-2: 3.4 m/s | RT3 | V3-2 3.7 m/s |
| | V3-3: 3.2 m/s | | V3-3 3.4 m/s |
| | V3-4: 3.0 m/s | | V3-4 3.2 m/s |
| RT2 | V2-1: 2.8 m/s | | V2-1 3.0 m/s |
| | V2-2: 2.6 m/s | RT2 | V2-2 2.8 m/s |
| | V2-3: 2.4 m/s | | V2-3 2.6 m/s |
| | V2-4: 2.2 m/s | | V2-4 2.4 m/s |
| RT1 | V1-1: 2.0 m/s | | V1-1 2.2 m/s |
| | V1-2: 1.8 m/s | RT1 | V1-2 2.0 m/s |
| | V1-3: 1.6 m/s | | V1-3 1.9 m/s |
| | V1-4: 1.4 m/s | | V1-4 1.8 m/s |
| | No Vehicle | | V0-Enter 1.7 m/s |

Referring now to FIG .8 an interzone networked system is shown. The transmitters in two zones Sz1 and Sz2 are connected via WAN, LAN or dedicated connection to interzone computation unit 81. The interzone computation unit adjusts the acceleration broadcasts dependent upon the information received from the detection points or received from the transmitters, if they are so equipped. The delta in acceleration for the SZ1 is only one example of how this embodiment may be applied. This scenario is based on a faster than anticipated dissipation in SZ2.

TABLE 2 interzone computation

| Transmit | Avg. Vel. | Delta Acc. |
|---|---|---|
| RT23 | 8 m/s | n/a |
| RT22 | 7.4 m/s | n/a |
| RT21 | 6.7 m/s | n/a |
| RT14 | 5.0 m/s | +.5/s2 |
| RT13 | 4.4 m/s | +.5/s2 |
| RT12 | 4.0 m/s | +.5/s2 |
| RT11 | 3.5 m/s | +.5/s2 |

As can be appreciated the flow of information need not flow from front to back, but can flow from back to front as well.

Figure 9:
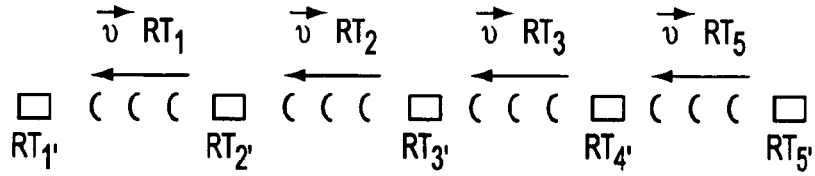
FIG. 9 illustrates a wireless linear flow of information in the transmission system in a first direction.
Figure 13:
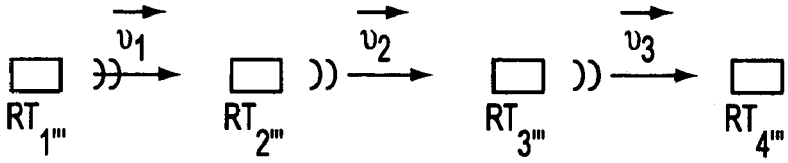
FIG. 13 illustrates a wireless linear flow of information in the transmission system in a second direction.

Referring now to FIG. 9 another alternate embodiment of the invention in a wireless front to back linear inter-transmitter data flow is shown. In a similar embodiment shown in FIG. 13 is a wireless back-to-front linear data flow. In either of the embodiments shown in FIG. 9 or FIG. 13 may be combined. if it is shown to be advantageous. The data flow is designed to adjust the transmission of the velocity limitations as it becomes necessary. In the linear data flow embodiments, each transmitter may be adjusted solely based on the data received from the neighbor simplifying the invention. Thus, in FIG. 9, RT1 needs only data from RT2 to adjust the transmitted speed optimally, and does not need to receive information from RT4.

Figure 10:
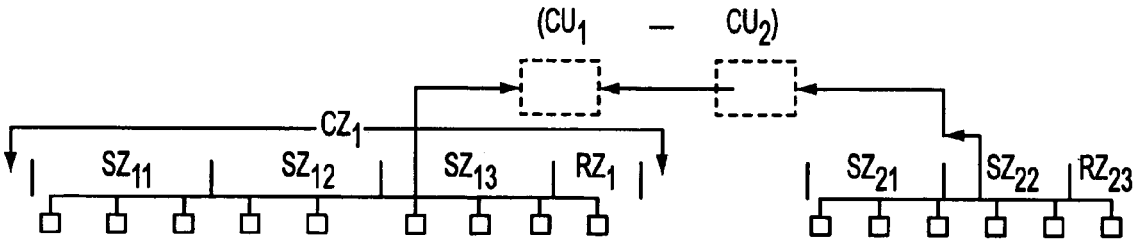
FIG. 10 illustrates a multiple congestion zone network.
Figure 12:
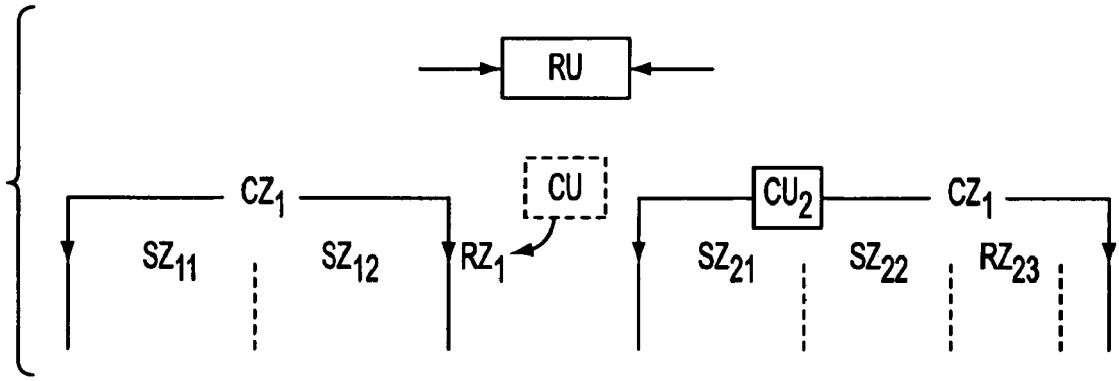
FIG. 12 illustrates a global intelligence system for traffic control.

FIG. 10 shows an embodiment which may be particularly advantageous for implementing the invention on a large scale in which computation units for each congestion zone CZ1 and CZ2, CU1 and CU2, respectively are connected to each other to share data to adjust transmitted speed which is controlled locally by CU1 and CU2. FIG. 12 shows a regional traffic computation system RU receiving information from CU1 and CU2, but unlike the embodiment in FIG. 10 RU may make overriding decisions regarding inter congestion zone CZ1 and CZ2 velocity control.

Figure 11:
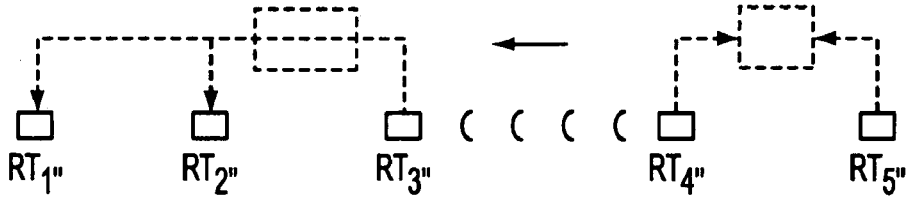
FIG. 11 illustrates a discrete computation network and flow of data.

FIG. 11 shows another alternate embodiment in which the modular aspects of a group of transmitters may be collected and applied to another group. For example, the data from RT4''' and RT5''' is collected and applied to RT1''' . . . RT3''' to adjust the transmitted acceleration limits. This embodiment may be particularly useful in applications which the conditions are marked from one part of the congestion reduction zone to the next. For example in a merge shown in FIG. 16, the conditions at which the merge lane has collapsed into the two remaining lanes (RT4''' . . . RT5''') may require a particular application, while the zones that include the merge lane (e.g. RT1''' . . . RT3''') require another application.

Figure 14:
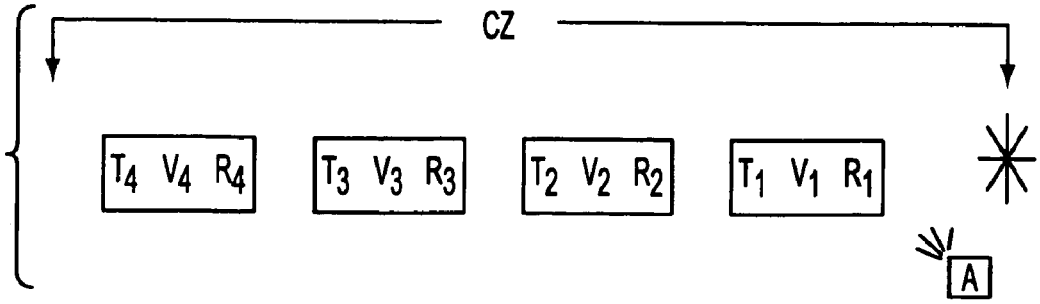
FIG. 14 is an alternate embodiment of the present invention wherein receivers and transmitters are located on vehicles in the congestion reduction zone.

Referring now to FIG. 14 another alternate embodiment of the invention is shown where the transmitter and receiver systems are located on vehicles in the congestion reduction zone. In this alternate embodiment, the inter-vehicle traffic control system, the transmitters T1 . . . T4 are activated when Activation module A transmits an EMF signal when an event at one or more detection points DP1 is detected. Such events may be the same or similar to those detailed above and include a low threshold velocity of one or more vehicles or other adverse traffic event.

The transmitters T1 . . . T4 are located on vehicles V1 . . . V4, respectively, along with receiver systems R1 . . . R4. The receiver systems R1 . . . R4 include a non-negative acceleration control module and possibly an optional deceleration or negative acceleration module. The inter-vehicle embodiment of the invention has particular advantages and drawbacks when compared to the preferred embodiment.

Advantages of the inter-vehicle system include the fact that activation modules A may be placed a various locations as they are necessary to traffic control, and are therefore more "portable" than the preferred embodiments. Much longer stretches of roadway may be covered. by the control system for less infrastructure cost. However, increasing the complexity of the electronics needed in the vehicle, transmitter, distance computation device, and receiving and acceleration control system would appear to decrease many of the economical advantages of the preferred embodiments which require only passive reception devices in vehicles coupled with acceleration or velocity controllers.

Another alternate implementation of the inter-vehicle system is where there are no external activation modules. However, the increasingly complex circuitry and transmission devices needed inside the automobile may prohibit many drivers from subscribing to such a system. However, the cost of serious traffic congestion results in lost revenue for governments and businesses as well as lost wages to individuals. As traffic infrastructure becomes increasingly volatile the cost of alternate embodiments may become an economically viable options even if devices for transmission and non-negative acceleration control must be provided to drivers.

Figure 15:
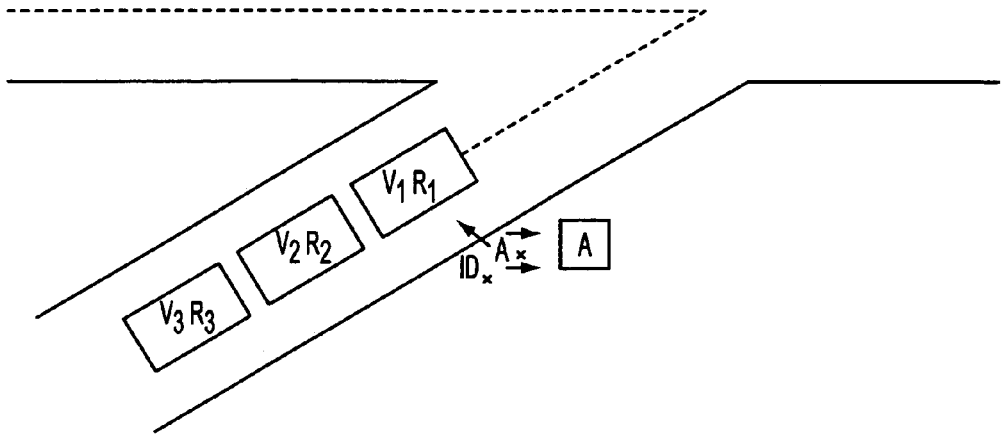
FIG. 15 is an alternate embodiment of the invention in a traffic control for a highway merge.

Referring now to FIG. 15, a simplified alternate embodiment for merge congestion is shown instead of an ineffective traffic light for an on-ramp that may or may not be effective at regulating merges during heavy traffic periods or even take into account that spacing in the travel lane TL may be such that regulating the merge lane ML is not needed. The simplified merge system has an activation or transmission device A at a targeted location at the end of the on-ramp. The activation device A may be connected to a timing or spacing detector TM which may be connected to detection devices at detection points DP1 or DP2, or simply include any required electronics for detecting appropriate criteria for merging. The activation module A may simply prevent vehicles from entering the merge into the travel lane TL by reducing or eliminating their ability to accelerate.

Figure 16:
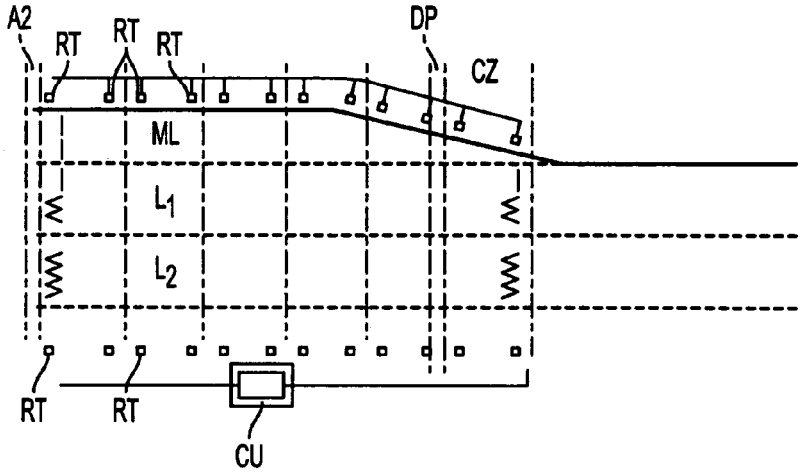
FIG. 16 is a second alternate embodiment for multiple lane traffic flow control in a highway merge.

Referring now to FIG. 16 a multiple lane embodiment of the invention is shown for a highway merge. The transmitters are shown at points through the congestion control zone on multiple sides of the highway. The flow of information from transmitter to transmitter (or simultaneously) will depend on the roadway conditions. However, in the illustrative merge, the critical zones or important zones are most likely where the merge finally ends and drivers fail to space in the travel lane, creating gridlock. Thus, information those zones would flow from the front of the congestion control zone to the back, either simultaneously, or in a staggered fashion, such that the vehicles multiple lanes can be spaces as to inhibit congestion.

Figure 17:
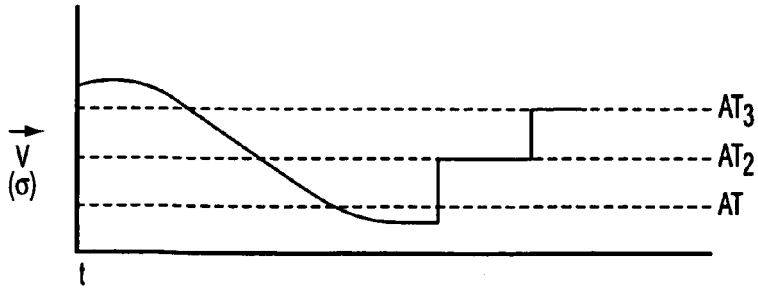
FIG. 17 is a sample diagram of unidirectional non-negative acceleration control in the present invention as implemented by a governor system.

Referring now to FIG. 17 an exclusively non-negative acceleration system is shown. The non-negative acceleration is part of a preferred embodiment of the invention and unlike the negative acceleration systems current used to prevent SUV rollover or other "slow down" mechanisms. Although it is contemplated that the present invention could use known deceleration devices in controlling the velocity of the vehicles, the reliability and safety of the velocity control system is though to be a more popular and economic implementation if vehicles are not "slowed" by external events. It is contemplated that limiting the positive acceleration when a vehicle has dropped below a low threshold speed would be a much more viable and safer option for drivers. Additionally, the redundancy required from an positive, or rather non-negative acceleration governor would be greatly reduced that for a device that could decelerate the vehicle as well.

FIG. 17 shows that a non-negative acceleration governor may be placed on standby but cannot be activated until the vehicle drops below a low threshold speed or event shown at as an activation threshold or AT. In a preferred embodiment the low threshold is zero, but it may be other speeds according to the conditions that are appropriate for the congested roadway. FIG. 17 also shows that two different transmissions to the non-negative acceleration governor system AT2 and AT3, respective resulting in three different discrete velocity levels (where the curve flattens out) for the vehicle at three points in time as the control transmitters relay the appropriate signals-to dissipate the traffic congestion.

An physical layer control embodiment of the invention (not shown) may also be contemplated in alternate embodiments without the need for equipping automobiles with non-negative acceleration systems. The stopped vehicle or slow activates the spacing system at the activation zone which allows spacers to prevent vehicles from bunching up or "stop and go." The Spacers can be physical devices such as Kevlar flags attached to a moving conveyor (with appropriate springs or other mechanical protection in the mechanical movement area or layer or can be electronic such as lights or diodes, but also can be transmitters which control the speed of the vehicle. A control layer includes all necessary logic and electronic needed to move or control the sensors. There are many different methods for configuring each representation layers shown, including the mechanical layer in which the spacers move back to the activation zone. The length of the speed control area is vital in determining what physical configuration should be used or if it is economical to use such as system.

A narrow strip down the center of the roadway containing the structures that control the spacers in addition to the spacers themselves may be sufficient for temporary use. However more permanent structures built into the roadway are contemplated.

The invention herein is described in several embodiments that are not meant to be exhaustive but rather illustrative only. As can be appreciated by traffic and transportation specialists, there are other way to implement the invention which do not depart from the scope of the invention and thus, the invention should be considered as defined by the claims below.

Having thus described my invention, I claim:

1. A traffic control system for use in reducing traffic congestion including: a plurality of non-negative acceleration limitation control units, each of said plurality of control units including a reception unit and a transmission unit, wherein a plurality of said reception units may be controlled by one of said transmission units; each of said plurality of reception units operatively coupled with a vehicle's acceleration system; wherein at least a portion of said non-negative acceleration limitation control units are activated when a speed detection device detects that a vehicle has reached a low threshold speed, wherein said reception units are activated by a transmitter at an entrance to a traffic congestion reduction zone wherein said acceleration of a first vehicle controlled by a first of said non-negative acceleration limitation control units is always less than a second vehicle being controlled by a second of said non-negative acceleration limitation control units, when said transmitter is active.

2. A device for assisting the control of traffic congestion including: a non-negative acceleration governor operatively coupled to a vehicle acceleration capability, wherein said non-negative acceleration governor cannot limit the positive acceleration of said vehicle unless the speed of a vehicle reaches a low threshold; and an activation device coupled to said non-negative acceleration governor, wherein said non-negative acceleration governor is activated only by said activation device.

3. The device as recited in claim 2 further comprising a distance detection device in said activation unit, said distance detection device being for detecting a distance between two vehicles.

4. The device as recited in claim 3, where said activation unit activates said non-negative acceleration unit when a threshold distance is detected.

5. The device as recited in claim 2, wherein said low threshold speed is zero.

6. The device as recited in claim 2, further including a receiver operatively coupled to said activation device.

7. The device as recited in claim 6, wherein said receiver is configured to receive EMF signals corresponding to a non-negative acceleration limit, said activation device translating said EMF signals and providing them to said non-negative acceleration governor.

8. A method for reducing traffic congestion including the acts of: placing a plurality of non-negative acceleration limiting reception devices in each of a plurality of vehicles; activating at least one of said plurality of non-negative acceleration limiting reception devices in a congestion reduction zone; and transmitting instructions to at least one of said plurality of non-negative acceleration limiting reception devices in at least one vehicle located in said congestion reduction zone, wherein said transmitted instructions cause the non-negative acceleration of a first vehicle to be limited to less than that of a second vehicle that is physically located in front of said first vehicle.

9. The traffic congestion reduction method as recited in claim 8, wherein said activation takes place when a traffic event is detected.

10. The traffic congestion reduction method as recited in claim 8, further including the step of deactivating said at least one of said plurality of non-negative acceleration limiting device.

11. The traffic congestion reduction method as recited in claim 8, wherein said transmitter is located at the base on an on-ramp, such that a vehicle may not enter a highway until instructions are transmitted to said non-negative acceleration limited reception device.

* * * * *